US007686442B2

(12) United States Patent
Katsumura

(10) Patent No.: US 7,686,442 B2
(45) Date of Patent: Mar. 30, 2010

(54) LIQUID CONTAINER WITH BENT AIR BUBBLE TRAP PASSAGE

(75) Inventor: Takayoshi Katsumura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 502 days.

(21) Appl. No.: 11/375,270

(22) Filed: Mar. 14, 2006

(65) Prior Publication Data

US 2006/0203053 A1 Sep. 14, 2006

(30) Foreign Application Priority Data

Mar. 14, 2005 (JP) ..... P2005-072048

(51) Int. Cl.
*B41J 2/19* (2006.01)
*B41J 2/175* (2006.01)

(52) U.S. Cl. ..... 347/92; 347/86

(58) Field of Classification Search ..... 347/86, 347/92, 7, 11; 73/290 V; 96/155
See application file for complete search history.

(56) References Cited

U.S. PATENT DOCUMENTS

| | | | | |
|---|---|---|---|---|
| 3,295,297 | A * | 1/1967 | Collins | 96/155 |
| 5,946,015 | A | 8/1999 | Courtney | |
| 6,036,305 | A | 3/2000 | Nagasaki et al. | |
| 6,644,791 | B1 | 11/2003 | Andrews | |
| 6,682,186 | B2 * | 1/2004 | Smith et al. | 347/92 |
| 6,957,882 | B2 * | 10/2005 | Wouters et al. | 347/86 |
| 2002/0071015 | A1 | 6/2002 | Kaga et al. | |
| 2002/0170353 | A1 * | 11/2002 | Usui et al. | 73/290 V |
| 2003/0103119 | A1 * | 6/2003 | Sakai et al. | 347/92 |
| 2003/0174181 | A1 * | 9/2003 | Nishioka et al. | 347/7 |
| 2004/0217995 | A1 | 11/2004 | Matsushita et al. | |
| 2004/0239736 | A1 * | 12/2004 | Miyazawa et al. | 347/86 |
| 2005/0243110 | A1 * | 11/2005 | Takahashi et al. | 347/7 |
| 2008/0036808 | A1 * | 2/2008 | Shinada et al. | 347/11 |

(Continued)

FOREIGN PATENT DOCUMENTS

EP 1 176 403 A2 1/2002

(Continued)

OTHER PUBLICATIONS

Extended European Search Report for European patent appln. No. 06005188.5-2304 (Nov. 6, 2007).

(Continued)

*Primary Examiner*—Stephen D Meier
*Assistant Examiner*—Carlos A Martinez, Jr.
(74) *Attorney, Agent, or Firm*—Stroock & Stroock & Lavan LLP

(57) ABSTRACT

A liquid container includes, in a container body 3, an ink containing portion 5, an ink supply portion 7, an ink leading path 9 for leading an ink stored in the ink containing portion 5 to the ink supply portion 7, and an atmosphere communication port 4, and an ink end sensor 11 for detecting an inflow of a gas to the ink leading path 9, thereby detecting that a residual amount of the ink in the ink containing portion 5 is zero is provided in the middle of the ink leading path 9, and furthermore, an air bubble trap passage 13 for catching air bubbles mixed in the ink is provided in the ink leading path 9 between a detecting position of the ink end sensor 11 and the ink containing portion 5.

17 Claims, 4 Drawing Sheets

U.S. PATENT DOCUMENTS

| | | | | |
|---|---|---|---|---|
| 2008/0036833 | A1* | 2/2008 | Shinada et al. | 347/86 |
| 2009/0015644 | A1* | 1/2009 | Shinada et al. | 347/92 |

FOREIGN PATENT DOCUMENTS

| | | | |
|---|---|---|---|
| EP | 1 314 565 | A2 | 5/2003 |
| EP | 1 388 419 | A1 | 2/2004 |
| GB | 2 161 117 | A | 1/1986 |
| GB | 2 326 378 | A | 12/1998 |
| JP | 60-262654 | A | 12/1985 |
| JP | 09-141890 | A | 6/1997 |
| JP | 2001-328278 | | 11/2001 |
| JP | 2003-237097 | A | 8/2003 |
| JP | 2004-167692 | A | 6/2004 |
| JP | 2004-195653 | | 7/2004 |

OTHER PUBLICATIONS

Combined Search and Examination Report for U.K. patent appln. No. GB0605109.8 (Jun. 20, 2006).

* cited by examiner

LIQUID CONTAINER WITH BENT AIR BUBBLE TRAP PASSAGE

BACKGROUND OF THE INVENTION

1. Technical Field of the Invention

The present invention relates to a liquid container of an atmosphere communication type which is suitable as an ink cartridge to be attached to an ink jet printer, for example.

2. Description of the Related Art

As an ink cartridge (a liquid container) to be attached to an ink jet printer, there have variously been proposed an atmosphere communication type comprising, in a container body to be attached to the printer, an ink containing portion (a liquid containing portion) for accommodating an ink, an ink supply portion (a liquid supply portion) to be connected to a print head (a liquid ejection portion) on the printer side, an ink leading path (a liquid leading path) for leading the ink stored in the ink containing portion to the ink supply portion, and an atmosphere communication port for introducing atmosphere from an outside into the ink containing portion with a consumption of the ink in the ink containing portion.

Moreover, some ink cartridges are provided with an ink residual amount detecting mechanism in which a sensor having a piezoelectric oscillator is disposed at a reference height in the liquid containing portion (for example, see JP-A-2001-328278).

The ink residual amount detecting mechanism serves to detect that the liquid level of the ink is reduced to the reference height based on a change in an oscillating characteristic (a residual oscillation) in the case in which a periphery of the sensor is filled with a ink liquid and the case in which atmosphere comes in contact with the periphery of the sensor when the ink liquid level of the liquid containing portion is reduced to the reference height due to the consumption of the ink by a print processing so that the outside atmosphere introduced into the liquid containing portion through an atmosphere communication port reaches a detecting position of the sensor with the consumption of the ink. A detection signal is utilized for a display of the residual amount of the ink or a notice of a time for exchange of the cartridge.

In the ink cartridge of the atmosphere communication type, the outside atmosphere introduced into the liquid containing portion through the atmosphere communication port with the consumption of the ink is changed into fine air bubbles due to a shock acting in the attachment and removal of the cartridge and floats in the ink liquid in some cases. When the air bubbles floating in the ink liquid are stuck to a surface of the sensor, the air bubbles thus stuck causes a change in a residual oscillation so that the presence of the ink cannot be detected accurately. Consequently, there is a possibility that it might be erroneously detected that the liquid level of the ink is reduced.

In order to prevent the erroneous detection, therefore, there has been known a technique for surrounding the sensor by a partition wall with a fine gap to permit a pass of the ink left and for preventing an intrusion of the air bubbles into the sensor side by a capillary force of a meniscus generated in the gap when the air bubbles reach the gap formed by the partition wall, thereby preventing the erroneous detection (for example, see JP-A-2004-195653, hereinafter referred to as 'JP-A-653).

In order to accurately give a notice of the time for exchange of the cartridge in use of a printer, it is effective that a sensor for detecting the presence of an ink is provided in the vicinity of a liquid supply portion to be an outlet of the ink to the printer side in order to quickly detect the fact that a residual amount of the ink in the liquid containing portion is zero.

Even if the sensor is provided in the vicinity of the liquid supply portion, however, the air bubbles mixed into the ink are stuck to the sensor and it is thus detected erroneously that the residual amount of the liquid in the liquid containing portion is zero in some cases.

It can be proposed that the sensor is provided in the vicinity of the liquid supply portion and a technique described in 'JP-A-653 (a technique for preventing a passage of air bubbles utilizing a meniscus) is applied in order to prevent the air bubbles in the ink from reaching the sensor side.

In the technique described in 'JP-A-653, however, in the case in which a cartridge removed from a printer is vibrated strongly or a strong shock is applied due to a drop in a situation in which a cartridge which is being used for changing a color is removed from the printer and is stored, for example, there is a possibility that the air bubbles might flow into the sensor side beyond a capillary force generated by a meniscus. Therefore, a reliability for preventing the erroneous detection is low.

For example, in some cases in which the liquid container is used in a cold district, the liquid freezes and expands, and goes out of an atmosphere communication port which is opened to the atmosphere. When the liquid container is returned into a normal temperature environment and the freezing liquid liquefies again, the atmosphere on the outside is drawn into the liquid containing portion through the atmosphere communication port. Also in this case, there is a possibility that air bubbles might be generated in the liquid to cause the erroneous detection of the sensor.

SUMMARY OF THE INVENTION

Therefore, it is an object of the invention to provide a liquid container which can prevent air bubbles mixed into a liquid of a liquid containing portion from being stuck to a liquid end sensor provided in the vicinity of a liquid supply portion and can accurately detect that a residual amount of the liquid in the liquid containing portion is zero also in the case in which a strong vibration acts on the liquid container or a shock acts due to a drop.

A liquid container according to one embodiment of the invention which can solve the problems is of an atmosphere communication type comprising, in a container body to be attached to an apparatus, a liquid containing portion, a liquid supply portion to be connected to a liquid ejection portion on the apparatus side, a liquid leading path for leading a liquid stored in the liquid containing portion to the liquid supply portion, and an atmosphere communication port for introducing atmosphere from an outside into the liquid containing portion with a consumption of the liquid in the liquid containing portion, wherein a liquid end sensor for detecting an inflow of a gas to the liquid leading path, thereby detecting that a residual amount of the liquid in the liquid containing portion is zero is provided in the middle of the liquid leading path, and an air bubble trap passage for catching air bubbles mixed into the liquid is provided in the liquid leading path between a detecting position of the liquid end sensor and the liquid containing portion.

According to the liquid container having such a structure, the air bubbles floating in the liquid flowing into the liquid leading path which is provided from the liquid containing portion toward the liquid supply portion are separated from the liquid and are caught when they pass through the air bubble trap passage provided on the upstream of the detecting position of the liquid end sensor in the liquid leading path. For this reason, the air bubbles can be prevented from flowing into the liquid end sensor. Accordingly, the air bubbles mixed into the liquid of the liquid containing portion can be prevented from being stuck to the liquid end sensor provided in the vicinity of the liquid supply portion and the fact that the residual amount of the liquid in the liquid containing portion is zero can be prevented from being erroneously detected before the terminal of the liquid (the boundary of a gas-liquid) flowing to the liquid supply portion passes through the liquid end sensor. Therefore, it is possible to accurately detect that the residual amount of the liquid in the liquid containing portion is zero.

In the liquid container according to the invention, moreover, it is preferable that the air bubble trap passage should have a vertical direction converting portion for converting a flow of the liquid into a vertical direction.

According to the liquid container having such a structure, the function of separating the air bubbles in the liquid is fulfilled by the vertical direction converting portion for converting the flow into a vertical direction. For this reason, the liquid flowing to the liquid supply portion is subjected to the processing of catching the air bubbles before reaching the liquid end sensor. Consequently, there is brought a state in which the mixed air bubbles are separated and removed.

In the liquid container according to the invention, furthermore, it is preferable that the air bubble trap passage should have a horizontal direction converting portion for converting the flow of the liquid into a horizontal direction.

According to the liquid container having such a structure, the function of separating the air bubbles in the liquid is fulfilled by the horizontal direction converting portion for converting the flow into a horizontal direction. For this reason, the liquid flowing to the liquid supply portion is subjected to the processing of catching the air bubbles before reaching the liquid end sensor. Consequently, there is brought a state in which the mixed air bubbles are separated and removed. There is employed a structure in which the vertical direction converting portion and the horizontal direction converting portion are combined properly. Thus, the liquid flowing to the liquid supply portion is repetitively subjected to the processing of catching air bubbles so that the air bubbles can be separated and removed more reliably.

In the liquid container according to the invention, moreover, it is preferable that the air bubble trap passage should include an air bubble collecting space having a passage section extended vertically and upward from front and rear passage positions.

According to the liquid container having such a structure, the air bubbles floating in the liquid can be stored in the air bubble collecting space having a passage section extended vertically and upward and a larger quantity of air bubbles can be collectively stored in the air bubble collecting space. The gas stored in the air bubble collecting space flows out of the air bubble collecting space with difficulty also in the case in which a strong vibration acts on the liquid container removed from an apparatus in the middle of use or a shock acts due to a drop because the longitudinal passage for the gas is positioned below the air bubble collecting space. In addition, a large quantity of air bubbles can be stored in one air bubble collecting space.

In the liquid container according to the invention, furthermore, it is preferable that the air bubble trap passage should have a dead end air bubble collecting space in a horizontal direction.

According to the liquid container having such a structure, the dead end air bubble collecting space getting out of the passage to the liquid supply portion can store the air bubbles floating in the liquid and can collectively store a large quantity of air bubbles.

In the liquid container according to the invention, moreover, it is preferable that a porous member for catching air bubbles should be provided in the middle of the air bubble trap passage or in the middle of the liquid leading path on an upstream from the detecting position of the liquid end sensor.

According to the liquid container having such a structure, the porous member provided in the middle of the passage efficiently catches the air bubbles mixed into the liquid. Consequently, it is possible to enhance an air bubble catching efficiency and to improve a reliability for catching the air bubbles.

In the liquid container according to the invention, furthermore, it is preferable that a liquid supply port of the liquid containing portion to which the liquid leading path or the air bubble trap passage is connected should be formed to be a passage having a circular section of a diameter of 2 mm or less.

According to the liquid container having such a structure, the liquid supply port to be the liquid outlet from the liquid containing portion acts as a passage having a circular section of a diameter of 2 mm or less and the liquid supply port itself exhibits a surface tension of a meniscus for preventing the outflow of the air bubbles. Consequently, it is possible to prevent the air bubbles from flowing from the liquid containing portion toward the liquid end sensor side. Thus, it is possible to lighten a burden on the air bubble trap passage, thereby enhancing a reliability for preventing the air bubbles from being stuck to the liquid end sensor.

In the liquid container according to the invention, moreover, it is preferable that a passage constituting the air bubble trap passage should be formed to have a rectangular passage section.

According to the liquid container having such a structure, the passage has a rectangular section. As compared with the case in which the formation is carried out by a passage having a circular section, therefore, a wasteful space is not left between the passages which are provided in parallel so that a complicated passage can be formed at a high density. Also in the case in which the air bubble trap passage is formed by resin molding, moreover, a moldability can be enhanced. In addition, in the case in which the passage has a rectangular section, a stagnation area having a slow flow is formed in the corner portions of the rectangular passage section and the corner portions in an upper part function as the air bubble collecting spaces for accumulating the air bubbles separated by the flow direction converting portion differently from the case of the passage having a circular section. Therefore, the function of catching the air bubbles can also be fulfilled.

In the liquid container according to the embodiment of the invention, the air bubbles floating in the liquid flowing into the liquid leading path provided from the liquid containing portion toward the liquid supply portion are separated from the liquid and are caught when they pass through the air bubble trap passage provided on the upstream of the detecting position of the liquid end sensor in the liquid leading path. Therefore, the air bubbles can be prevented from flowing into the liquid end sensor side.

Accordingly, the air bubbles mixed into the liquid of the liquid containing portion can be prevented from being stuck to the liquid end sensor provided in the vicinity of the liquid supply portion. Thus, it is possible to accurately detect that the residual amount of the liquid in the liquid containing portion is zero without an erroneous detection.

DETAILED DESCRIPTION OF THE INVENTION

An example of an embodiment of a liquid container according to the invention will be described below in detail with reference to the drawings.

Figure 1:
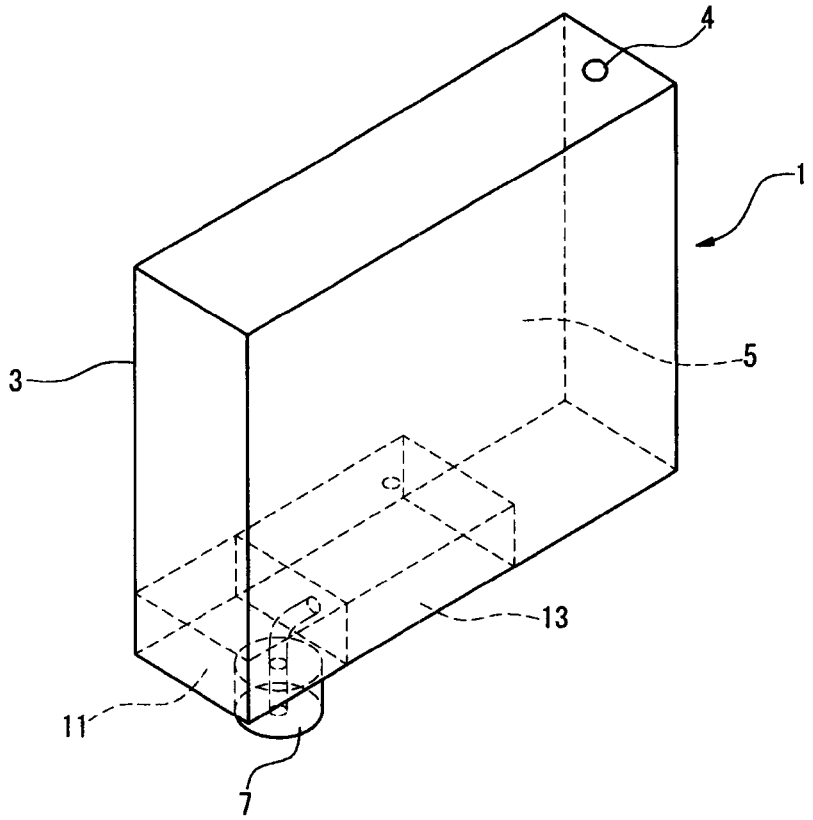
FIG. 1 is a schematic perspective view showing an embodiment of a liquid container according to the invention.
Figure 2:
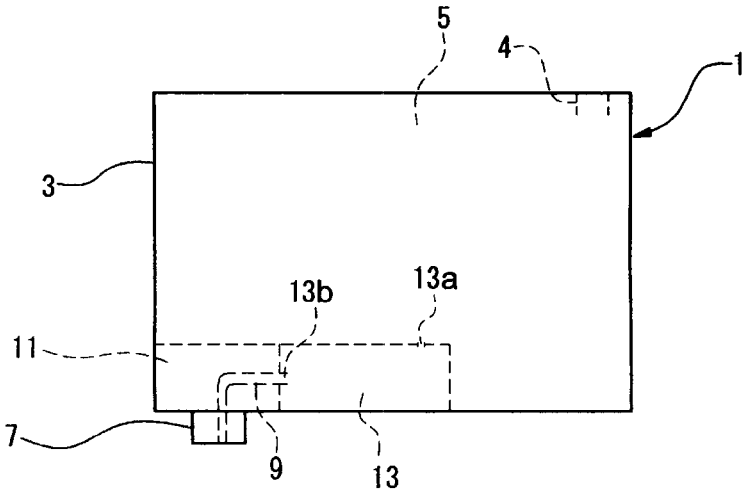
FIG. 2 is a side view showing the liquid container illustrated in FIG. 1.
Figure 3:
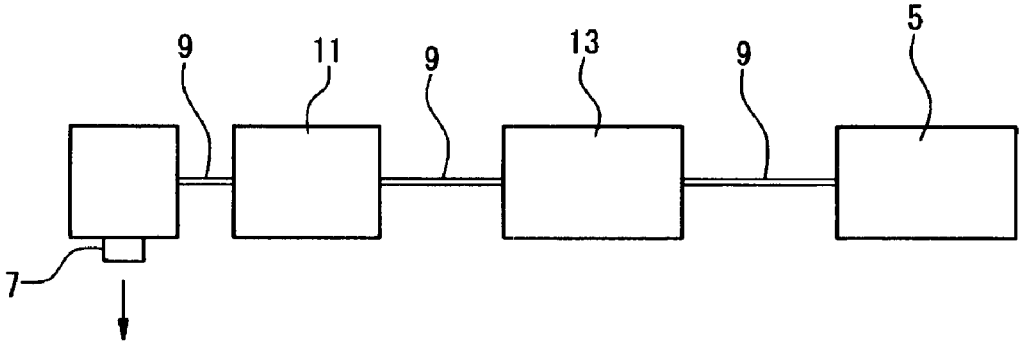
FIG. 3 is a typical view showing a path through which a liquid flows in the liquid container illustrated in FIG. 1.
Figure 4:
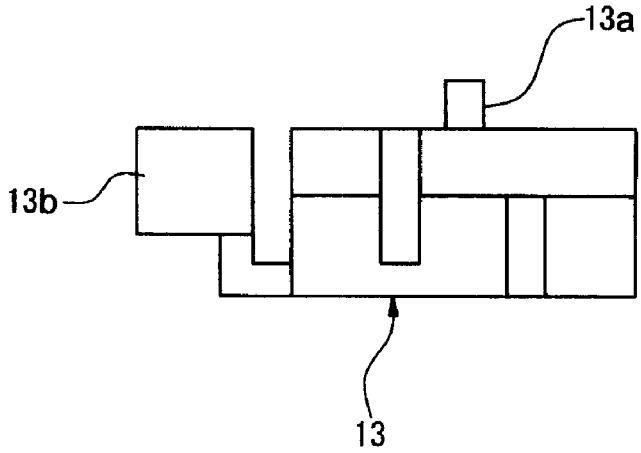
FIG. 4 is a side view showing an air bubble trap passage illustrated in FIG. 1.
Figure 5:
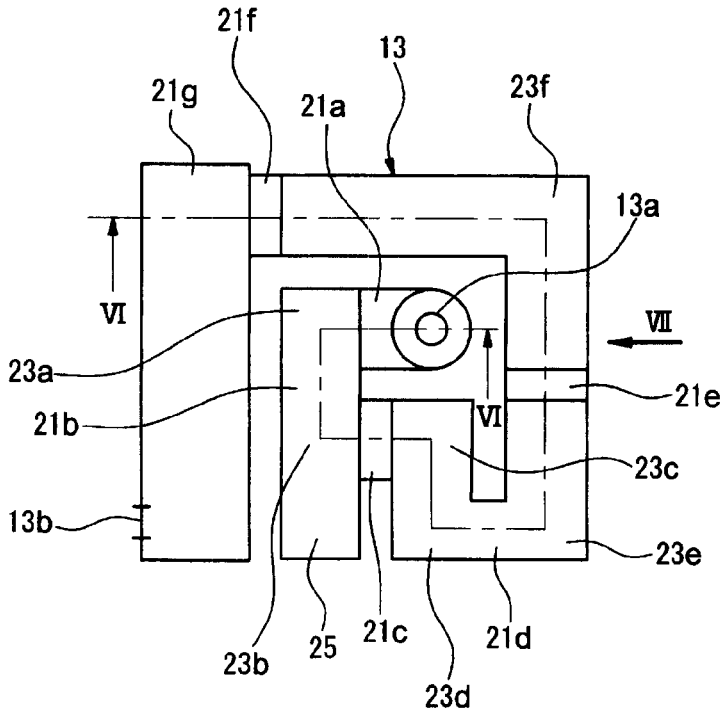
FIG. 5 is a plan view showing the air bubble trap passage illustrated in FIG. 4.
Figure 6:
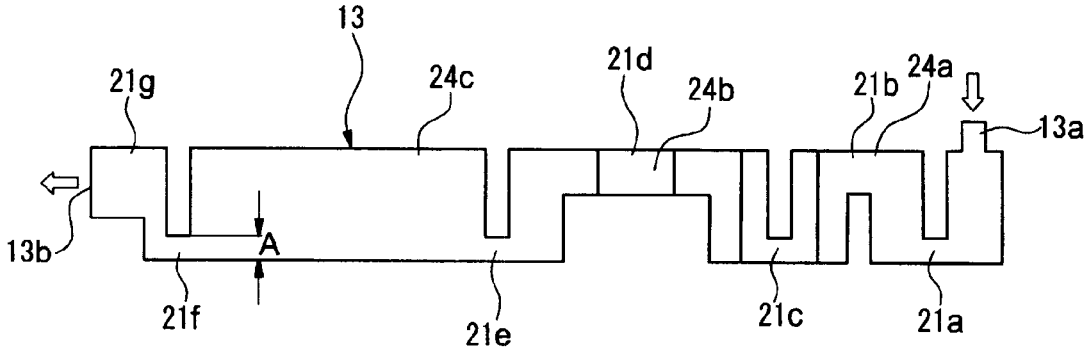
FIG. 6 is a sectional view taken along a VI-VI line in FIG. 5.
Figure 7:
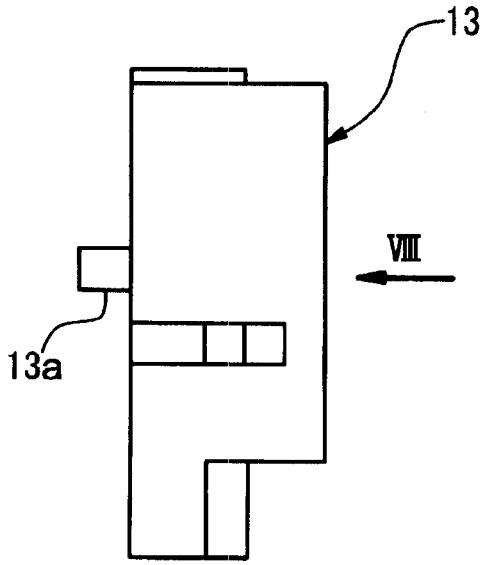
FIG. 7 is a view seen in an arrow of VII in FIG. 5.
Figure 8:
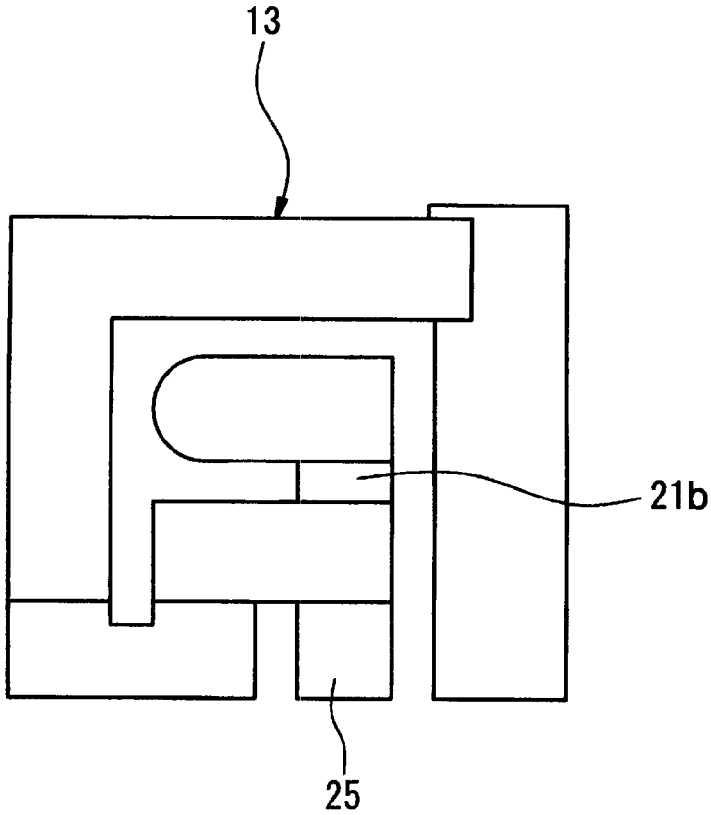
FIG. 8 is a view seen in an arrow of VIII in FIG. 7.

FIGS. 1 to 8 show an embodiment of a liquid container according to the invention, and FIG. 1 is a schematic perspective view showing the liquid container according to the embodiment of the invention, FIG. 2 is a side view showing the liquid container illustrated in FIG. 1, FIG. 3 is a typical view showing a path through which a liquid flows in the liquid container illustrated in FIG. 1, FIG. 4 is a side view showing an air bubble trap passage illustrated in FIG. 1, FIG. 5 is a plan view showing the air bubble trap passage illustrated in FIG. 4, FIG. 6 is a sectional view taken along a VI-VI line in FIG. 5, FIG. 7 is a view seen in an arrow of VII in FIG. 5, and FIG. 8 is a view seen in an arrow of VIII in FIG. 7.

In a printer of an ink jet type, the liquid container according to the embodiment is an ink cartridge 1 to be attached to a cartridge attachment portion provided on a carriage mounting a print head to be a liquid ejection portion thereon.

The ink cartridge 1 is of an atmosphere communication type comprising, in a container body 3 to be attached to an apparatus (the cartridge attachment portion of the printer), an ink containing portion (a liquid containing portion) 5 for storing an ink, an ink supply portion (a liquid supply portion) 7 to be connected to a print head on the apparatus side (the cartridge attachment portion of the printer), an ink leading path (a liquid leading path) 9 for leading the ink stored in the ink containing portion 5 to the ink supply portion 7, and an atmosphere communication port 4 for introducing atmosphere from an outside into the ink containing portion 5 with a consumption of the ink in the ink containing portion 5.

In the embodiment, an ink end sensor (a liquid end sensor) 11 for detecting an inflow of a gas to the ink leading path 9, thereby detecting that a residual amount of the ink in the ink containing portion 5 is zero is provided in a close position to the ink supply portion 7 in the ink leading path 9.

The ink end sensor 11 is disposed to cause a sensor formed by a piezoelectric oscillator to face an inner part of the ink leading path 9 and serves to detect that the residual amount of the ink is zero based on a change in an oscillating characteristic in the case in which a periphery of the sensor facing the ink leading path 9 is filled with the ink and the case in which the atmosphere comes in contact with the periphery of the sensor when outside atmosphere introduced from the atmosphere communication port 4 into the ink containing portion 5 with the consumption of the ink reaches a detecting position of the sensor.

Moreover, an air bubble trap passage 13 for catching air bubbles mixed into the ink is provided in the middle of the ink leading path 9 between the detecting position of the ink end sensor 11 and the ink containing portion 5.

As shown in FIGS. 4 and 5, the air bubble trap passage 13 takes, as a whole schematic structure, the shape of an almost rectangular parallelepiped which can be accommodated in a bottom portion of the container body 3.

As shown in FIG. 5, in the air bubble trap passage 13, an inlet 13*a* into which the ink flows from the ink containing portion 5 is formed on an almost center of an upper surface and an outlet 13*b* for discharging the ink is formed on an outer side surface positioned on the sensor side.

As shown in FIGS. 5 and 6, in the air bubble trap passage 13, a plurality of vertical direction converting portions 21*a* to 21*g* for converting the flow of the ink into a reverse direction to a vertical direction (a gravity direction when the ink cartridge 1 is mounted on the printer) and a plurality of horizontal direction converting portions 23*a* to 23*f* for converting the flow into a horizontal direction (a direction perpendicular to the gravity direction) at approximately 90 degrees are combined to form a complicated passage structure having a large number of bent portions.

The air bubble trap passage 13 is provided with air bubble collecting spaces 24*a* to 24*c* having a passage section extended vertically and upward from a standard passage sectional position A (see FIG. 6) to be a position of a longitudinal passage employed for an outlet end of the air bubble trap passage 13 in several portions in the middle of the passage.

In the example shown in the drawing, the air bubble collecting space 24*c* positioned on the most downstream side is set to have the largest volume.

In the middle of the air bubble trap passage 13 according to the embodiment, furthermore, a dead end air bubble collecting space 25 is formed.

Moreover, the inlet 13*a* to which the air bubble trap passage 13 is connected is formed to be a passage having a circular section in a diameter of 2 mm or less. In the embodiment, the air bubble trap passage 13 is positioned on an end at the ink containing portion 5 side in the ink leading path 9, and the inlet 13*a* of the air bubble trap passage 13 also serves as an ink supply port (a liquid supply port) from the ink containing portion 5 to the ink leading path 9.

In the embodiment, furthermore, the air bubble trap passage 13 is formed by injection molding of a resin, and each passage constituting the air bubble trap passage 13 has a passage section set to be rectangular.

In the ink cartridge 1 described above, even if the ink cartridge 1 is shaken in the middle of use or a temperature is changed so that air bubbles are mixed into the ink, the air bubbles floating in the ink flowing into the ink leading path 9 provided from the ink containing portion 5 toward the ink supply portion 7 are separated from the ink and are caught when they pass through the air bubble trap passage 13 provided on the upstream from the detecting position of the ink end sensor 11 disposed in the middle of the ink leading path 9. For this reason, the air bubbles can be prevented from flowing into the ink end sensor 11 side.

Accordingly, the air bubbles mixed into the ink in the ink containing portion 5 are not stuck to the ink end sensor 11 provided in the vicinity of the ink supply portion 7. Consequently, it is possible to accurately detect that the residual amount of the ink in the ink containing portion 5 is zero (a so-called ink end) without erroneously detecting that the residual amount of the ink in the ink containing portion 5 is zero.

Referring to the ink cartridge 1 according to the embodiment, moreover, the vertical direction converting portions 21*a* to 21*g* for converting the flow into a vertical direction and the horizontal direction converting portions 23*a* to 23*f* for converting the flow into a horizontal direction are combined so that a space saving, three-dimensional and complicated passage structure can be formed in the air bubble trap passage 13, and the function of separating the air bubbles in the ink is fulfilled in the respective flow direction converting portions. Therefore, the ink flowing to the ink supply portion 7 is repetitively subjected to a processing of catching the air bubbles before reaching the ink end sensor 11 so that the mixed air bubbles can be separated and removed perfectly. Consequently, it is possible to reliably prevent the generation of an erroneous detection from being caused by the sticking of the air bubbles mixed in the ink to the ink end sensor 11.

In the ink cartridge 1 according to the embodiment, furthermore, the air bubbles separated from the ink in the flow direction converting portions 21*a* to 21*g* and 23*a* to 23*f* are stored in the air bubble collecting spaces 24*a* to 24*c* having the passage sections extended vertically and upward from the longitudinal passage and dead end air bubble collecting spaces 25*a* and 25*b*. A large quantity of air bubbles can be collectively stored by means of the air bubble collecting spaces 24*a* to 24*c*, 25*a* and 25*b* so that it is possible to prevent the catching error of the air bubbles from being made by an insufficient capacity of the air bubble collecting space.

Since the longitudinal passage is positioned below the air bubble collecting space, moreover, the gas stored in the air bubble collecting spaces 24*a* to 24*c* flows out of the air bubble collecting space with difficulty also in the case in which a strong vibration acts on the ink cartridge 1 removed from the apparatus in the middle of use or a shock acts due to a drop. Furthermore, a large quantity of air bubbles can be stored in one air bubble collecting space.

Even if the gas stored in one air bubble collecting space flows to an adjacent passage by the vibration or shock acting on the ink cartridge 1, moreover, the flowing gas is caught or stored again by the vertical direction converting portion or the dead end air bubble collecting space which is positioned on the downstream. For this reason, the gas cannot reach the ink end sensor 11.

Also in the case in which a strong vibration acts on the ink cartridge 1 removed from the apparatus in the middle of use or a shock acts due to a drop, accordingly, the air bubbles mixed in the liquid of the ink containing portion 5 are not stuck to the ink end. sensor 11 provided in the vicinity of the ink supply portion 7. Consequently, it is possible to reliably detect that the residual amount of the ink liquid in the ink containing portion 5 is zero without an erroneous detection.

In the ink cartridge 1 according to the embodiment, furthermore, the ink supply port (the inlet 13*a* of the air bubble trap passage 13) to be the ink outlet from the ink containing portion 5 acts as a passage having a circular section in a diameter of 2 mm or less and the ink supply port (the inlet 13*a*) forms a meniscus for preventing the outflow of the air bubbles. Consequently, it is possible to. prevent the air bubbles from flowing from the ink containing portion 5 toward the ink end sensor 11 side. Thus, it is possible to lighten a burden for catching the air bubbles into the air bubble trap passage 13, thereby enhancing a reliability for preventing the air bubbles from sticking to the ink end sensor 11.

In the ink cartridge 1 according to the embodiment, moreover, the passage has a rectangular section. As compared with the case in which the formation is carried out by a passage having a circular section, therefore, a wasteful space is not left between the passages which are provided in parallel so that a complicated passage can be formed at a high density. Also in the case in which the air bubble trap passage 13 is formed by resin molding, furthermore, a moldability can be enhanced.

In addition, in the case in which the passage has a rectangular section, a stagnation area having a slow flow is formed in the corner portions of the rectangular passage section and the corner portions in an upper part function as the air bubble collecting spaces for accumulating the air bubbles separated by the flow direction converting portion differently from the case of the passage having a circular section. Therefore, it is also possible to easily catch or collect the air bubbles.

A porous member for catching the air bubbles may be provided in the middle of the air bubble trap passage 13 or in the middle of the ink leading path 9 on the upstream from the detecting position of the ink end sensor 11.

Thus, the porous member provided in the middle of the passage efficiently catches the air bubbles mixed in the ink through very small holes. Consequently, it is possible to enhance an air bubble catching efficiency and to improve a reliability for catching the air bubbles.

Thus, the ink cartridge 1 has such a structure that the passage is converted into various directions and the air bubbles can be caught or collected in the various directions. Also in the case in which the ink cartridge 1 is caused to take any posture, therefore, it is possible to reliably prevent the air bubbles from reaching the ink end sensor 11. Consequently, precision in the accurate detection of an ink end is very high and it is possible to eliminate a drawback that the ink cartridge 1 is exchanged with the ink left.

The use of the liquid container according to the invention is not restricted to the ink cartridge according to the embodiment. For example, the liquid container according to the invention is suitable for supplying a liquid to a liquid injecting head of a liquid injecting device. For example, a liquid injecting head (a print head) of a recording apparatus of an ink jet type, a coloring agent injecting head of a color filter manufacturing apparatus for manufacturing a color filter of a liquid crystal display, an electrode material (conducting paste) injecting head for forming an electrode of an organic EL display or an FED (a surface emitting display), and furthermore, a bioorganism injecting head of a biochip manufacturing apparatus for manufacturing a biochip and a sample injecting head to be a precision pipette are applied to the liquid injecting apparatus.

What is claimed is:

1. A liquid container mountable on a liquid ejection apparatus, comprising:

a container body having a liquid containing portion containing liquid therein;

a liquid supply portion connectable to a liquid ejection portion of the liquid ejection apparatus;

a liquid leading path leading the liquid in the liquid containing portion to the liquid supply portion;

an atmosphere communication port communicating with atmosphere;

a liquid end sensor disposed at a detecting position within the container body and in the liquid leading path, and operable to detect whether the liquid is present at the detecting position; and an air bubble trap passage disposed in the liquid leading path within the container body between the detecting position and the liquid containing portion, and having a plurality of bent portions so that a passage in which the liquid flows is changed in various directions for trapping air bubbles in the liquid;

wherein the air bubble trap passage is formed into a coiled shape around an axis extending parallel with a gravity direction defined when the liquid container is mounted on the liquid ejection apparatus; and wherein an inlet port of the air bubble trap passage is formed to have a circular section so as to form a meniscus therein.

2. The liquid container according to claim 1, wherein the air bubble trap passage includes an air bubble collecting space having a passage section extended upward relative to a gravity direction.

3. The liquid container according to claim 1, wherein the air bubble trap passage has a dead end air bubble collecting space in a horizontal direction perpendicular to a horizontal direction.

4. The liquid container according to claim 1, wherein a porous member for trapping air bubbles is provided in the air bubble trap passage or in the liquid leading path in an upstream side of the detecting position.

5. The liquid container according to claim 1, wherein the circular section of the inlet port has a diameter of 2 mm or less.

6. The liquid container according to claim 1, wherein a passage constituting the air bubble trap passage has a rectangular passage section.

7. The liquid container according to claim 1, wherein the air bubble trap passage includes:

a main passage communicating from a liquid supply port of the liquid containing portion to the liquid supply portion of the liquid container; and at least one branch passage branched from the main passage and having a dead end.

8. The liquid container according to claim 7, wherein the at least one branch passage extends in a gravity direction.

9. The liquid container according to claim 7, wherein the at least one branch passage extends to a horizontal direction.

10. The liquid container according to claim 1, wherein air bubble trap passage includes a plurality of vertical direction converting portions that changes the flow of the liquid by 180 degrees relative to a gravity direction.

11. The liquid container according to claim 1 wherein air bubble trap passage includes a plurality of horizontal direction converting portions that changes the flow of the liquid by 90 degrees relative to a horizontal direction.

12. The liquid container according to claims 1, wherein the air bubble trap passage includes:

a first portion having a first passage sectional area; and a second portion having a second passage sectional area different from the first sectional area.

13. The liquid container according to claim 12, wherein a height of the first portion in a gravity direction is different from that of the second portion.

14. The liquid container according to claim 1, wherein an outlet port of the air bubble trap passage is formed to have a circular section.

15. The liquid container according to claim 1, wherein the air bubble trap passage is provided in a bottom portion of the container body.

16. The liquid container according to claim 1, wherein the air bubble trap passage is configured to change the flow of the liquid which is directed to a downward direction to an upward direction relative to a gravity direction at least two times.

17. A liquid container mountable on a liquid ejection apparatus, comprising:

a container body having a liquid containing portion containing liquid therein;

a liquid supply portion connectable to a liquid ejection portion of the liquid ejection apparatus;

a liquid leading path leading the liquid in the liquid containing portion to the liquid supply portion;

an atmosphere communication port communicating with atmosphere;

a liquid end sensor disposed at a detecting position within the container body and in the liquid leading path, and operable to detect whether the liquid is present at the detecting position; and an air bubble trap passage disposed in the liquid leading path within the container body between the detecting position and the liquid containing portion, and having a plurality of bent portions so that a passage in which the liquid flows is changed in various directions for trapping air bubbles in the liquid;

wherein the air bubble trap passage is formed into a coiled shape around an axis extending parallel with a gravity direction defined when the liquid container is mounted on the liquid ejection apparatus.

* * * * *